US009856715B2

(12) United States Patent
Themig et al.

(10) Patent No.: US 9,856,715 B2
(45) Date of Patent: Jan. 2, 2018

(54) STAGE TOOL FOR WELLBORE CEMENTING

(76) Inventors: Daniel Jon Themig, Calgary (CA); Robert Joe Coon, Missouri City, TX (US)

( * ) Notice: Subject to any disclaimer, the term of this patent is extended or adjusted under 35 U.S.C. 154(b) by 621 days.

(21) Appl. No.: 14/386,723

(22) PCT Filed: May 8, 2012

(86) PCT No.: PCT/CA2012/000438
§ 371 (c)(1),
(2), (4) Date: Feb. 24, 2015

(87) PCT Pub. No.: WO2013/138896
PCT Pub. Date: Sep. 26, 2013

(65) Prior Publication Data

US 2015/0159466 A1 Jun. 11, 2015

Related U.S. Application Data

(60) Provisional application No. 61/614,405, filed on Mar. 22, 2012.

(51) Int. Cl.
*E21B 33/14* (2006.01)
*E21B 34/14* (2006.01)
(Continued)

(52) U.S. Cl.
CPC ..... *E21B 33/146* (2013.01); *E21B 21/103* (2013.01); *E21B 33/14* (2013.01);
(Continued)

(58) Field of Classification Search
CPC ..... E21B 33/14; E21B 33/146; E21B 33/16; E21B 34/10; E21B 34/103; E21B 21/103
See application file for complete search history.

(56) References Cited

U.S. PATENT DOCUMENTS 2,549,198 A 4/1951 Hayward
3,097,699 A * 7/1963 Orr ..... E21B 33/146 166/289
(Continued)

FOREIGN PATENT DOCUMENTS

CN 201568012 U 9/2010
EP 0622522 A2 11/1993
(Continued)

OTHER PUBLICATIONS

Shaughnessy, John et al.; Optimizing HTHP Cementing Operations; IADS/SPE Drilling Conference, Dallas, Texas, USA, Feb. 26-28, 2002; IADC/SPE 74483.
(Continued)

*Primary Examiner* — Jennifer H Gay

(57) ABSTRACT

A stage tool and a method for stage cementing a wellbore annulus. The method includes: running into a wellbore toward bottom hole with a tubing string to a position in the wellbore; setting the tubing string in the wellbore to create the wellbore annulus between the tubing string and a wall of the wellbore; opening a cementing port through a side pocket structure positioned alongside the tubing string; pumping cement through the cementing port; and closing the cementing port to hold the cement in the annulus.

19 Claims, 5 Drawing Sheets

(51) Int. Cl.
*E21B 21/10* (2006.01)
*E21B 34/10* (2006.01)

(52) U.S. Cl.
CPC ..... *E21B 34/10* (2013.01); *E21B 34/103* (2013.01); *E21B 34/14* (2013.01)

(56) References Cited

U.S. PATENT DOCUMENTS

| | | | | |
|---|---|---|---|---|
| 3,130,784 | A * | 4/1964 | Pennington, II | E21B 33/14 166/269 |
| 3,253,655 | A | 5/1966 | Brown | |
| 3,789,926 | A | 2/1974 | Henley et al. | |
| 4,058,165 | A | 11/1977 | Holden et al. | |
| 4,176,717 | A | 12/1979 | Hix | |
| 4,403,659 | A | 9/1983 | Upchurch | |
| 4,429,747 | A | 2/1984 | Williamson | |
| 4,487,263 | A | 12/1984 | Jani | |
| 4,602,684 | A | 7/1986 | Van Wormer et al. | |
| 4,674,569 | A | 6/1987 | Revils et al. | |
| 4,751,967 | A | 6/1988 | Blandford et al. | |
| 5,038,862 | A | 8/1991 | Giroux et al. | |
| 5,314,015 | A | 5/1994 | Streich et al. | |
| 5,411,095 | A | 5/1995 | Ehlinger et al. | |
| 5,443,124 | A | 8/1995 | Wood et al. | |
| 5,494,107 | A | 2/1996 | Bode | |
| 5,609,178 | A | 3/1997 | Hennig et al. | |
| 5,826,661 | A | 10/1998 | Parket et al. | |
| 5,890,538 | A | 4/1999 | Beirute et al. | |
| 6,082,458 | A | 7/2000 | Schnatzmeyer | |
| 6,244,342 | B1 | 6/2001 | Sullaway et al. | |
| 6,293,342 | B1 | 9/2001 | McGarian et al. | |
| 6,799,635 | B2 | 10/2004 | Schultz et al. | |
| 6,802,374 | B2 | 10/2004 | Edgar et al. | |
| 6,907,936 | B2 | 6/2005 | Fehr et al. | |
| 7,108,067 | B2 | 9/2006 | Themig et al. | |
| 7,228,897 | B2 * | 6/2007 | Holt, Jr. | E21B 21/103 166/117.5 |
| 7,237,611 | B2 | 7/2007 | Vincent et al. | |
| 7,290,612 | B2 | 11/2007 | Rogers et al. | |
| 7,322,412 | B2 | 1/2008 | Badalamenti et al. | |
| 7,373,980 | B2 | 5/2008 | Lewis et al. | |
| 7,500,526 | B2 | 3/2009 | Telfer | |
| 7,654,324 | B2 | 2/2010 | Chase et al. | |
| 7,665,520 | B2 | 2/2010 | Szarka et al. | |
| 7,748,463 | B2 | 7/2010 | Revheim | |
| 7,762,333 | B2 | 7/2010 | Themig et al. | |
| 7,866,402 | B2 | 1/2011 | Williamson, Jr. | |
| 7,938,186 | B1 | 5/2011 | Badalamenti et al. | |
| 2004/0112599 | A1 * | 6/2004 | Holt, Jr. | E21B 21/103 166/285 |
| 2004/0177962 | A1 | 9/2004 | Bour | |
| 2007/0261850 | A1 | 11/2007 | Giroux et al. | |
| 2008/0011482 | A1 | 1/2008 | Badalamenti et al. | |
| 2008/0135248 | A1 | 6/2008 | Talley et al. | |
| 2008/0196889 | A1 | 8/2008 | Bour et al. | |
| 2008/0251253 | A1 | 10/2008 | Lumbye | |
| 2009/0071655 | A1 | 3/2009 | Fay | |
| 2009/0107675 | A1 | 4/2009 | Eriksen et al. | |
| 2009/0288838 | A1 * | 11/2009 | Richards | E21B 34/063 166/374 |
| 2010/0163253 | A1 | 7/2010 | Caldwell et al. | |
| 2012/0247767 | A1 * | 10/2012 | Themig | E21B 21/103 166/289 |
| 2015/0159466 | A1 * | 6/2015 | Themig | E21B 33/14 166/285 |
| 2015/0337624 | A1 * | 11/2015 | Themig | E21B 33/146 166/285 |

FOREIGN PATENT DOCUMENTS

| | | | | |
|---|---|---|---|---|
| EP | 0594390 | A2 | 4/1994 | |
| EP | 0913554 | A2 | 5/1999 | |
| WO | WO 2005/040547 | A1 | 5/2005 | |
| WO | WO 2009/132462 | | 11/2009 | |
| WO | WO 2011/057416 | A1 | 5/2011 | |
| WO | WO 2011057416 | A1 * | 5/2011 | E21B 21/103 |

OTHER PUBLICATIONS

Moore, Robert et al.; High Temperature Wells with Lost-Circulation Demands and Reverse Circulation Placement Technique Using Foamed Cement Systems: Two Case Histories; SPE Technical Conference and Exhibition, Denver, Colorado, USA, Oct. 5-8, 2003; SPE 84563.

Griffith, J. E. et al.; Reverse Circulation of Cement on Primary Jobs Increase Cement Column Height Across Weak Formations; SPE Production Operations Symposium, Oklahama City, OK, USA, Mar. 21-23, 1993; SPE 25440.

Marriot, Tim et al.; Revers-Circulation Cementing to Seal a Tight Liner Cap; Offshore Technology Conference, Houston, Texas, USA, Apr. 30-May 3, 2007; OCT 18839.

Marquaire, R. et al., Primary Cementing by Reverse Circulation Solves Critical Problem in hte North Hassi-Messaoud Field, Algeria; Journal of Petroleum Technology' Feb. 1966; pp. 146-150; SPE111.

Davies, Jason et al.; Reverse Circulation of Primary Cementing Jobs—Evaluation and Case History; IADS/SPE Drilling Conference, Dallas, Texas, USA, Mar. 2-4, 2004; IADC/SPE 87197.

Michel, Charlie et al.; Reverse Circulation with Coiled Tubing—Results of 1600+ Jobs; SPE/ICoTA Coiled Tubing Conference and Exhibition, Houston, Texas, USA, Mar. 23-24, 2004; SPE 89505.

* cited by examiner

STAGE TOOL FOR WELLBORE CEMENTING

FIELD

The invention relates to a tool for wellbore operations and, in particular, a stage tool for wellbore cementing.

BACKGROUND

In wellbore operations, cementing may be used to control migration of fluids outside a liner installed in the wellbore. For example, cement may be installed in the annulus between the liner and the formation wall to deter migration of the fluids axially along the annulus.

Often cement is introduced by flowing cement down through the wellbore liner to its distal end and forcing it around the bottom and up into the annulus where it is allowed to set. Occasionally it is desirable to introduce cement into the annulus without pumping it around the bottom end of the liner. A stage tool may be used for this purpose. A stage tool allows cement to be introduced to the annulus through the liner wall along the length of the liner.

SUMMARY

In accordance with a broad aspect of the present invention, there is provided a stage tool for wellbore annular cementing, comprising: a main body including a tubular wall with an outer surface and a longitudinal bore extending from a top end to a bottom end; a side pocket extending adjacent to the tubular wall, the side pocket including an outer wall defining a chamber between the outer wall and the longitudinal bore, the outer wall having an outwardly facing surface; an inner cementing port passing through the tubular wall and, when opened, providing fluidic access between the longitudinal bore and the chamber; an outer cementing port passing through the outer wall and, when opened, providing fluidic access between the chamber and the outwardly facing surface; a side pocket closure positioned between the inner cementing port and the outer cementing port and moveable within the chamber from a position sealing against fluid communication between the longitudinal bore and the outwardly facing surface to a position retracted from the inner cementing port and the outer cementing port to permit fluid flow through the chamber between the longitudinal bore and the outwardly facing surface; and a closing plug in the side pocket and moveable within the chamber from a retracted position to permit fluid flow through the chamber between the longitudinal bore and the outwardly facing surface and a position sealing against fluid communication between the longitudinal bore and the outwardly facing surface.

In accordance with another broad aspect, there is provided a method for stage cementing a wellbore annulus, the method comprising: running into a wellbore toward bottom hole with a tubing string to a position in the wellbore; setting the tubing string in the wellbore to create the wellbore annulus between the tubing string and a wall of the wellbore; opening a cementing port through a side pocket structure positioned alongside the tubing string; pumping cement through the cementing port; and closing the cementing port to hold the cement in the annulus.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein:

FIG. 2 including FIGS. 2A to 2F, wherein FIG. 3 including FIGS. 3A to 2F are views describing further aspects of the invention.

DETAILED DESCRIPTION OF VARIOUS EMBODIMENTS

Figure 1:
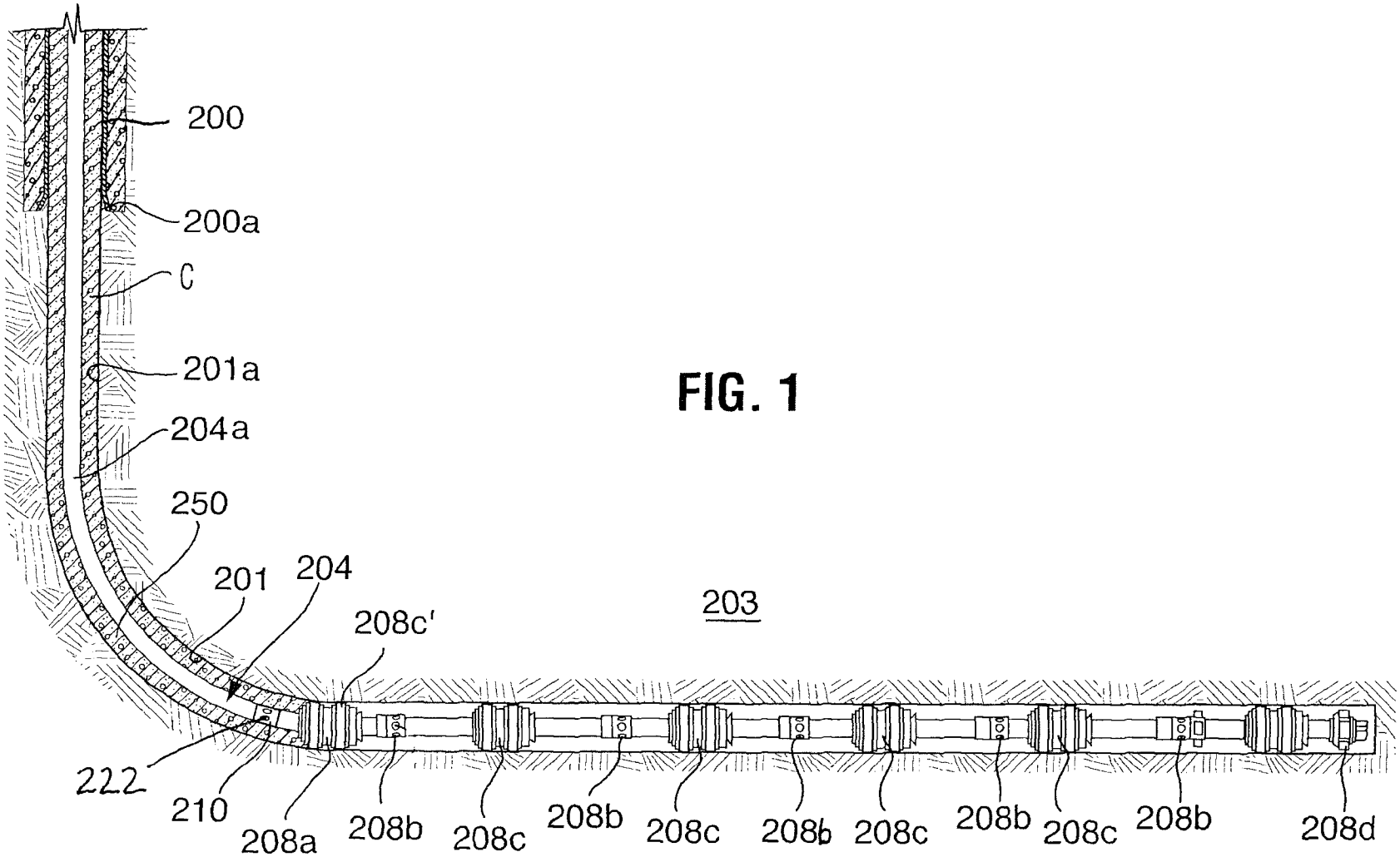
FIG. 1 is schematic sectional view through a wellbore with a tubing string installed therein.

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

In wellbore operations, for example, as shown in FIG. 1, generally a surface hole is drilled and surface casing 200 is installed and cemented in place to protect surface soil and ground water from wellbore operations and to prevent cave in. Thereafter, an extended wellbore 201 may be drilled below the surface casing point 200*a* to reach a formation of interest 203. Sometimes further casing is installed below the surface casing. Where operations are to be conducted using a liner 204. The liner can extend from a point above the lower most casing point, in this case casing point 200*a* with an active, lower portion of the liner extending out beyond casing point 200*a* at the bottom of the cased section of the well.

According to the current invention, a process and installation are suggested that permit a liner 204 to be supported in an extended wellbore 201 by stage cementing below any casing point 200*a*, as shown, which may be of the surface casing or a lower section of casing. The liner, therefore, can be run in, set and cemented in a well including in an open hole, uncased section of the well. The liner 204 has an upper end, a lower end, a tubular wall defining an inner diameter and an outer surface and, installed along its length, a stage tool 210, which separates the string into an upper portion 204*a*, above (uphole of) the stage tool, and a lower portion, below (downhole of) the stage tool. The lower portion may contain active components 208*a*, 208*b*, etc. of the liner. Cement C may be introduced into the annulus 250 to fill a portion of the annulus along a length of the liner to cement, and therefore seal off, that portion of the annulus between the liner and the open hole wall 201*a*. The cement may be introduced to fill a selected portion of the annulus, for example, to create a column extending back from the stage tool to the lowest cased section of the well.

Active components on the liner may take various forms such as, for example, selected from one or more of packers, slips, stabilizers, centralizers, fluid treatment intervals (such as may include fluid treatment ports, nozzles, port closures, etc.), fluid production intervals (such as may include fluid inflow ports, screens, inflow control devices, etc.), etc. For example, in one embodiment active components may include slips 208*a*, multistage fracturing components such as sleeve valves 208*b*, including hydraulic ports such as fracing ports and packers 208*c*', 208*c* for zone isolation, a blow out plug 208*d*, etc.

The liner may be run in and positioned in the well by any of various procedures. Once in place, the liner may be positioned by various means including by slips 208*a* and/or packers 208*c*, 208*c*' in the well. The slips or packers may in some embodiments be set by pressuring up the string. For example, in some frac operations, packers 208*c*, 208*c*' are carried on the liner for zone isolation. Once the liner is positioned in the wellbore, the packers are set to create annular seals between the liner and the wellbore wall. In some frac operations, the packers are set in a substantially horizontal section of the well, downhole of the heel. In such systems it may be beneficial, as shown, to create a cement column from the uppermost packer 208*c*' to a point above the lower most casing point, for example to the top of the liner. This may isolate the formation at the heel of a horizontal well and may provide stability to the hole.

Stage tool 210 includes one or more ports 222 and a valve to control flow through the ports from the annulus to the inner bore. The valve may be operated to open the ports to permit cement to flow therethrough to achieve circulation between the string inner bore and annulus 250.

After the stage tool's circulation ports 222 are opened, cement may be pumped by fluid circulation through the ports. In the illustrated embodiment, cement is pumped from above down through the inner bore of the liner toward the stage tool and out through ports 222 of the stage tool to annulus 250.

After the stage tool's circulation ports are opened, cement may be pumped therethrough into the annulus. In one embodiment, a spacer is pumped first, followed by a cement slurry, another spacer and finally a displacement fluid. After introduction of cement to the annulus, it may be held in the annulus until it sets. While various means may be employed to maintain the cement in the annulus, generally the stage tool includes or works with a hydraulically driven closure that closes ports 222.

Referring to FIG. 2, a stage tool 310 for installation in a wellbore liner is shown. Stage tool 310 may include a tubular body including a wall 311 with an outer surface 312, an inner bore 314 defined by an inner wall surface 316, a first end 318 and a second end 320. On outer surface 312 is a side pocket including an outer wall 326. A pocket chamber 328 is defined between the outer surface and the outer wall. The outer wall has an outwardly facing side 326*a* opposite the pocket chamber 328. Outwardly facing side 326*a* and outer surface 312 merge into one another and are effectively a uniform surface.

A cementing port extends through the side pocket and in this embodiment includes an inner cementing port 322*a* through tubular wall 311 and an outer cementing port 322*b* through outer wall 326. Together ports 322*a* and 322*b* form a circulation path through which fluids can pass between inner bore 314 and outer surface 312, which when the tool is installed in a wellbore is open to the annular area about the tool. Inner cementing port 322*a* passes through tubular wall 311 and, when open, provides fluidic access between the longitudinal bore and the pocket chamber and outer cementing port 322*b* passes through outer wall 326 and, when open, provides fluidic access between chamber 328 and outer surface 312.

A cementing port closure 330 is positioned to control fluid flow through the cementing ports. In this embodiment, cementing port closure 330 is positioned in chamber 328 between inner cementing port 322*a* and outer cementing port 322*b* and is moveable within the side pocket chamber from a sealing position sealing against fluid communication between bore 314 and outwardly facing side 326*a* to a position retracted from the inner cementing port and the outer cementing port to permit fluid flow through the ports and the chamber between the longitudinal bore and the outwardly facing surface 326*a*.

Stage tool 310 may be intended for use in wellbore applications for placement in a wellbore, as defined by wall 301*a*, for actuation to permit cementing of a section of the annulus 350 about a borehole liner. The tubular body may be formed of materials useful in wellbore applications such as of pipe, liner, casing, etc. and may be incorporated as a portion of a tubing string. Bore 314 may be in communication with the inner bore of a tubing string such that pressures may be controlled therein and fluids and tools may be communicated from surface, such as for wellbore treatment therethrough. The tubular body may be formed in various ways to be incorporated in a tubular string. For example, the tubular body may be formed integral or connected by permanent means, such as welding, with another portion of the tubular string. Alternately, the ends 318, 320 of the tubular body may be formed for engagement in sequence with adjacent tubulars in a string. For example, the ends may be formed as threaded pins or boxes, as shown, to allow threaded engagement with adjacent tubulars.

Figure 2A:
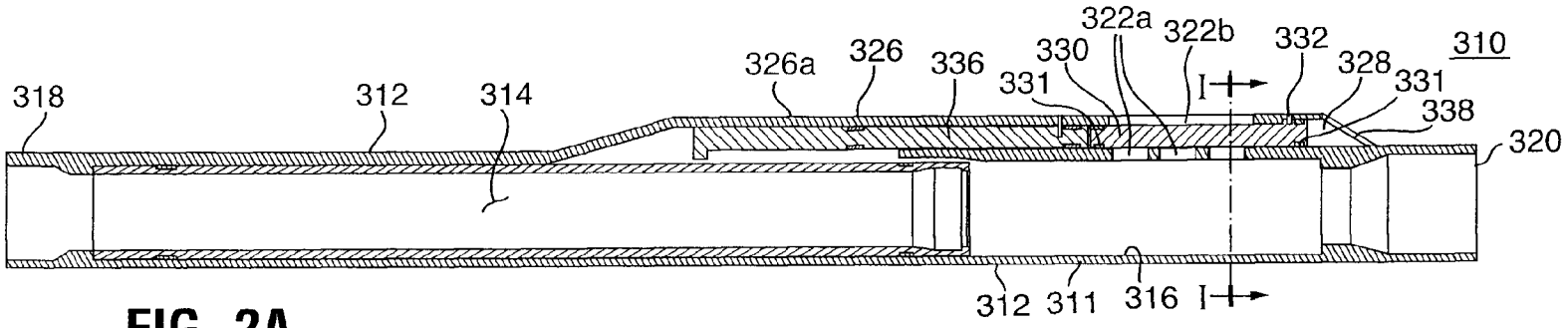
FIGS. 2A to 2E are axial sectional views of a stage tool in a run in, an open for cement circulation, a ready for closing, a closed and a back-up closed, respectively, positions according to one aspect of the present invention
Figure 2B:
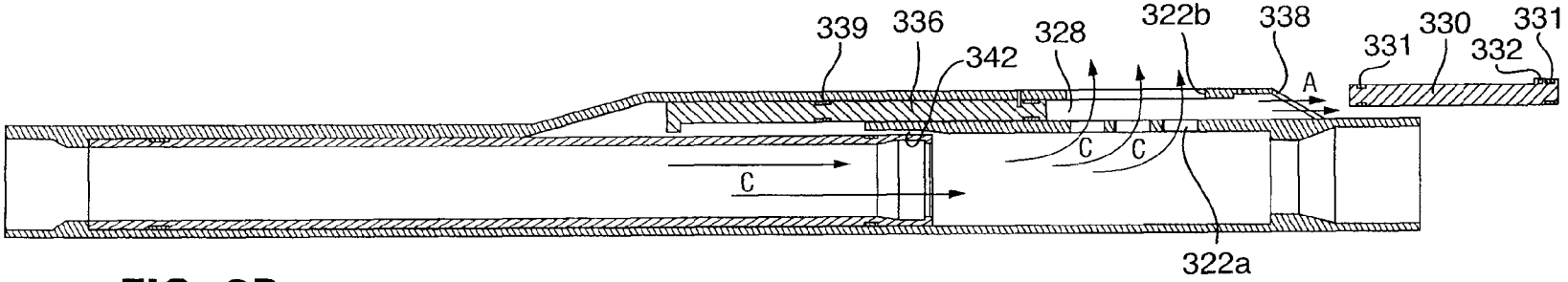
Figure 2C:
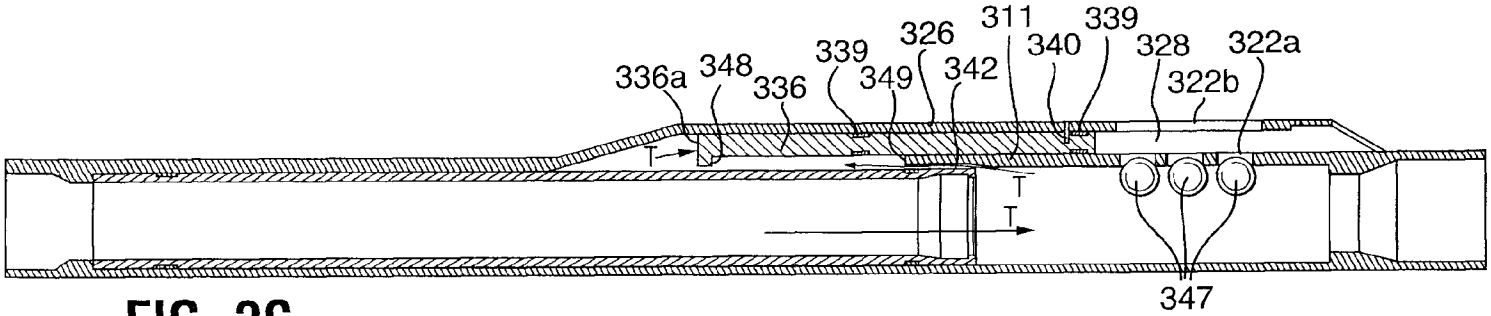
Figure 2D:
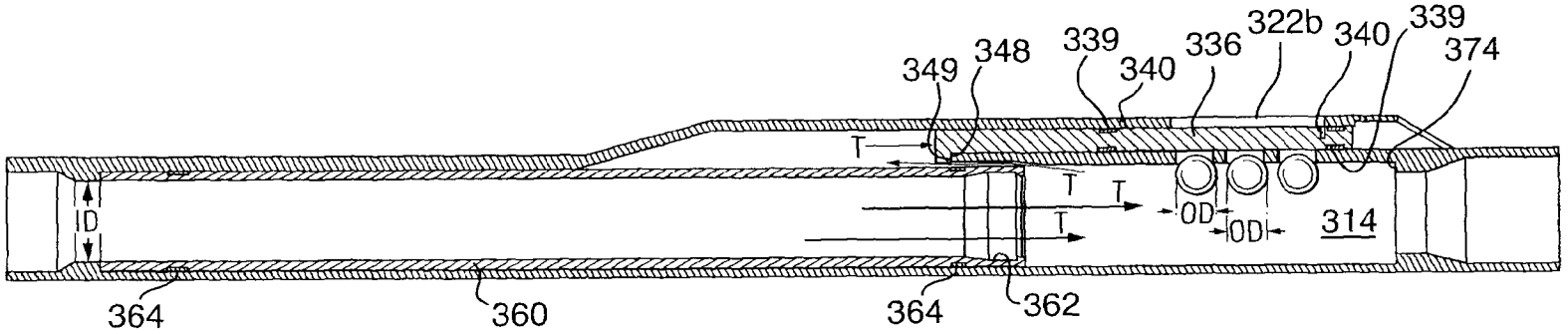
Figure 2E:
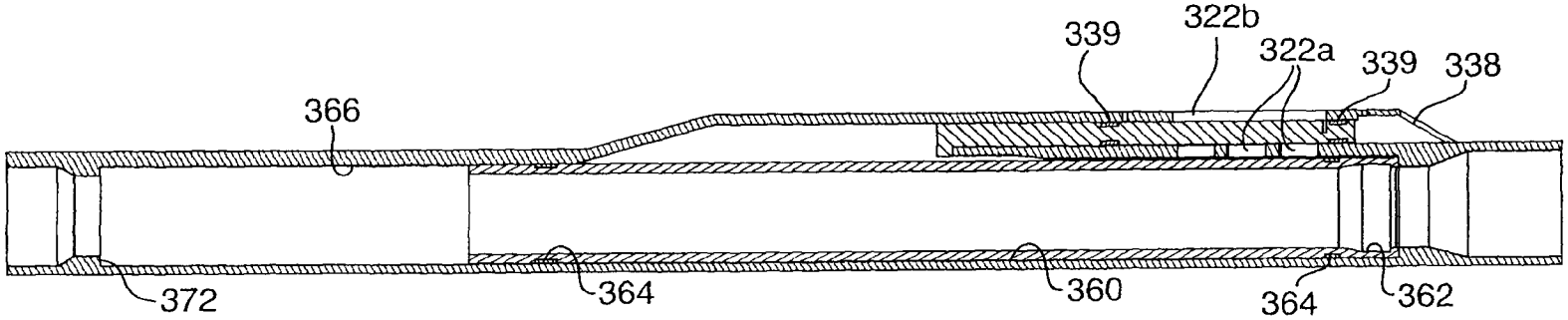

Stage tool 310 may be manipulated between a plurality of positions. As shown by the drawings, the stage tool may be manipulated between a first, run in position (FIG. 2A), a second, cementing position (FIG. 2B) and a third, closed position (FIG. 2D). In addition, there may be a back-up closed position (FIG. 2E).

The condition of the ports 322*a*, 322*b* determines some of the states of the stage tool. For example, in the run in position, ports 322*a*, 322*b* are closed with closure 330 positioned between ports 322*a*, 322*b* to block fluid communication therebetween, while in the cementing position ports 322*a*, 322*b* are open to fluid flow therethrough (i.e. closure 330 is removed from the blocking position between ports 322*a*, 322*b*). After cementing is complete (FIG. 2D), fluid communication between the ports 322*a*, 322*b* is again blocked to maintain the cement in the annulus. While in some embodiments, a closure may be moved back to again close fluid flow between ports 322*a*, 322*b*, in the illustrated embodiment, a closing plug 336 is provided in, and is moveable through, chamber 328 into a blocking position between the ports.

The stage tool can facilitate a stage cementing operation as it can be manipulated between the run in position (FIG. 2A) and the cementing position (FIG. 2B) by hydraulics, without tripping a tool into string and the stage tool can be closed (FIGS. 2C and 2D) also by hydraulics without tripping a tool into the string. Also, no full bore plugs need be launched and functionality can be achieved without any rigid parts obstructing the inner bore drift diameter. Thus, in some cases, no milling is necessary after the cementing operation and full bore access past the stage tool is available before and after cementing. Also, unlike stage tools with seals set against the inner diameter, the closed port condition after cementing of FIG. 2D cannot be compromised by the passage of tools through the inner diameter.

Reviewing the stage tool in greater detail, the side pocket is positioned alongside the tubular wall. It is desirable to provide an inner diameter 314 within wall 311 that is not significantly reduced over the inner diameter through the remainder of the tubing string in which the stage tool is connected. In one embodiment, therefore, the side pocket protrudes beyond the OD of wall 311. For example, the side pocket may be formed by connecting outer wall 326 to the outer surface of wall, as by welding. Wall 326 and outer surface 312 create a tubular shaped enclosure defining chamber 328 therein.

Figure 2F:
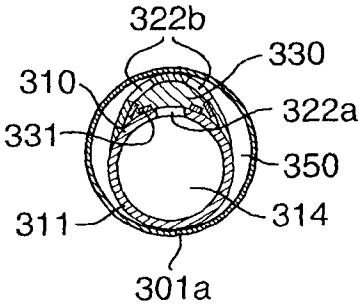
FIG. 2F is a sectional view along line I-I of FIG. 2A.

Ports 322*a*, 322*b* may be configured, sized and positioned to facilitate operations. For example, there may be a plurality of one or both ports, as shown, and their open area may be selected to facilitate flow of viscous materials therethrough. The outer cementing ports may be positioned to resist plugging against the formation. For example, as best seen in FIG. 2F, ports 322*b* may be positioned along the sides, for example along both sides, of the side pocket outer wall 326 rather than directly at its apex. This way, at least some ports tend to remain open to the annulus even where the maximum outer diameter of the stage tool is not much less than the inner diameter of the borehole.

The side pocket is formed to accommodate closure 330 and is formed to permit sliding movement of the closure within chamber 328 between the port blocking and the retracted positions. To permit hydraulic movement of closure 330 through chamber 328, side pocket wall 326 has an elongate form such that chamber 328 includes a substantially uniform cross section along the length over which the closure is intended to move.

Closure 330 can have the form of an elongate plug and can be driven along the length of chamber 328 that has the substantially uniform cross section, such as by establishing a pressure differential across a portion of the closure in the direction that the closure can move within the chamber. For example, the closure can be moved by hydraulic force in a manner similar to a piston. Seals 331 may be positioned to resist pressure leaks through chamber about the closure, both with respect to communication between ports 322*a* and 322*b* and such that the pressure differential can be established between the ends of the closure to move it through chamber 328. A holding mechanism, such as shear pin 332 may be installed to engage closure 330 to hold the closure in place until a sufficient pressure differential is established to overcome the holding force of the shear pin.

Pressure is communicated to the closure in the side pocket. While pressure communicating channels could be provided through which the hydraulic pressure in the tubing string can be communicated from inner bore 314 to the closure, in the illustrated embodiment of FIG. 2, for example, tubing pressure is communicated to the closure through inner cementing port 322*a*. A vent 338 is provided from chamber 328 to permit the closure to move as driven by hydraulic pressure. In this embodiment, vent 338 opens through outer wall 326 to outer surface 312 such that the pressure differential across closure 330 can be readily established between tubing pressure and annular pressure (communicated through vent 338). While chamber 328 and vent 338 need only allow movement of closure 330 within the chamber away from a sealing position between the ports, in this embodiment, vent 338 is sized to be at least as large as the closure such that the closure can pass fully out of the side pocket through the vent, when a pressure differential is generated thereacross.

Closing plug 336 is also positioned in chamber 328. The side pocket is formed to accommodate closing plug 336 and is formed to permit movement of the closing plug within chamber 328 between its initial retracted position and its port blocking position. For example, the closing plug can have an elongate plug form with a cross sectional shape similar to that of closure 330 and closing plug 336 can be driven along the length of the side pocket that has the substantially uniform cross section, such as by establishing a pressure differential across a portion of the closing plug in the direction that the closing plug can move within chamber 328. For example, the closing plug can be moved within chamber 328 by hydraulic force in a manner similar to a piston. Seals 339 may be positioned to resist pressure leaks through chamber along closing plug such that the pressure differential can be established between the ends of the closing plug to move it through chamber 328. Seals may also be positioned on the closing plug to form a seal against communication therepast between ports 322*a* and 322*b*, when the closing plug is in its final port blocking position. A holding mechanism, such as shear pin 340, may be installed to hold the closing plug in place until a sufficient pressure differential is established to overcome the holding force of the shear pin.

It is to be understood that the chamber, closure 330 and closing plug 336 can take other forms. For example, the side pocket chamber could be an annular space extending about the circumference of wall 311 and the closure and closing plug could be cylindrical or semi cylindrical sleeves moveable within the annular chamber. However, even with this change the function and operation may remain the same.

Closing plug 336 can be moved within the side pocket by hydraulic manipulation. In the illustrated embodiment of FIG. 2, for example, tubing pressure is communicated to an end 336*a* of the closing plug through opening 342 from inner bore 314 to chamber 328. Vent 338 and outer cementing port 322*b* communicate annular pressure to the opposite end of closing plug 336. Between opening 342 and vent 338/outer cementing port 322*b*, a pressure differential can be established across closing plug 336 between tubing pressure and annular pressure, provided flow through ports 322*a* is sealed off. Ports 322*a* can be plugged in various ways. To seal off ports 322*a*, plugging material can be dropped that is selected to plug ports 322*a*. The plugging material is comprised of solid structures selected to be less than the full bore inner diameter ID of bore 314 but to have at least one dimension larger than the diameter across ports 322*a*. The solid structures of the plugging material may take many forms, for example, the plugging material may include fibers, platelets, sheet form materials or balls. The plugging material may be selected to be able to remain down hole without interference in subsequent through tubing operations, be capable of removal by self-destruction (i.e. dissolution, etc.) down hole, be capable of removal by drilling and/or be capable of circulation out of the hole with returns. In this embodiment, the plugging material includes balls 347 having a substantially spherical shape. Balls 347 may be launched from surface in sufficient numbers to plug up all the ports 322*a*. Balls 347 each have a significantly smaller OD than, for example less than half and in one embodiment less than ⅓, the full bore ID of bore 314 but have an OD greater than the distance across the largest port 322*a*, such that they can't pass through the inner ports. Each port 322*a* may have edges formed as a circle and one spherical ball can sit against and create a seal with the edges of each port. The balls can selectively seal ports 322*a* while opening 342 remains open. In particular, in this embodiment balls 347 will have no effect on opening 342 due to its non-cooperating shape. The balls need only create a seal against ports 322*a* for a very short time, such as a minute or less, in order to permit closure of the plug 336. The balls of the illustrated embodiment have a specific gravity of 0.7 to 1.3 or possibly 0.9 to 1.2 to ensure that they flow easily in cement or flush fluids, which are generally water based. Their small size and shape ensure that the balls can readily be pushed aside and will not become an obstruction in the well. Further, they are formed of materials that can be milled up with a typical milling tool during a cleanup run, if they remain in the string. If desired, the balls can be formed of material that is incapable of accommodating the pressures used in later operations. For example, if the stage tool is to be used in a string with pressure actuated pistons or ball seats, such as is disclosed in applicants U.S. Pat. No. 6,907,936, the balls may be formed to fail (i.e. collapse, shatter or deform) at pressures exceeding 1000 psi such that they are incapable of seating on and pressure actuating the pistons, ball seats, etc. of the string, which are often secured to be actuated only at pressures higher than 1000 psi.

A stop such as shoulder 348 is provided on closing plug 336 to stop its movement through the chamber. Shoulder 348 protrudes out to enlarge the outer diameter of the closing plug such that it is stopped from moving further into chamber 328. Shoulder 348 is positioned with consideration to the length of the closing plug, the positions of ports 322*a*, 322*b* and the closing plug's seals to ensure that the closing plug is stopped in a position blocking fluid communication through ports 322*a*, 322*b*.

A back up sleeve 360 may be provided in the stage tool as a contingency, in case closing plug 336 fails to properly seal. Sleeve 360 is positioned in inner bore 314 and has an engagement profile 362, rendering it shiftable by a shifting tool. Sleeve 360 carries seals 364 and is sized to span the entire ported length of the stage tool inner wall 316 including across ports 322*a* and opening 342.

In use, the stage tool of FIG. 2 may be secured into a tubing string by connection of tubulars at ends 318, 320. The stage tool may be run into and set in the hole in a condition as shown in FIG. 2A. In this condition, the stage tool has a full open bore ID and closure 330 closes any circulation through ports 322*a*, 322*b*. Once the string is set in the hole, tool 310 may be manipulated to a condition shown in FIG. 2B for stage cementing. In the illustrated embodiment, applied pressure pumps closure 330 out the bottom, arrows A, of the side pocket and this provides a flow path through ports 322*a*, 322*b* and vent 338 to cement the annulus. After the introduction of cement, arrows C, the tool may be manipulated, as shown in FIG. 2C, to a condition shown in FIG. 2D to close off communication between the annulus and the inner bore of the tool. In particular, balls 347 may be dropped after the cementing is complete and may be pumped to seal against ports 322*a*. Typically, two to three times as many balls are dropped as ports for sufficient redundancy to ensure that the ports are sealed off. Once ports 322*a* are sealed off, this permits a pressure differential to be established across closing plug 336 since tubing pressure, arrows T, is communicated to end 336*a* through opening 342 and the other end of the closing plug is exposed to annular pressure. Closing plug 336 then moves to close off the cementing path through ports 322*a*, 322*b* (FIG. 2D).

If for any reason closing plug 336 fails to seal, back up sleeve 360 can be shifted down to isolate the whole side pocket from inner bore 314 (FIG. 2E).

Considering the operation of the tool of FIG. 2 in greater detail, in preparation for use closure 330 and closing plug 336 are installed in side pocket chamber 328 and back up sleeve 360 is installed in bore 314. Closure 330 is releasably set by pin 332 in a position sealing fluid communication between ports 322*a*, 322*b* such that fluid leakage through the ports out of bore 314 is deterred. Closing plug 336 is releasably set in chamber 328 by pin 340 in a position retracted from ports 322*a*, 322*b*. Sleeve 360 is set in the inner bore retracted from ports 322*a* and opening 342, which in this embodiment is a gap between wall 316 and sleeve 360, but could be entirely open.

Stage tool 310 is installed in a tubular string with its inner bore 314 in communication with the inner diameter of the tubing string. The string, including tool 310, is then run into the wellbore. Generally, the string will be run in until the stage tool is positioned in an uncased portion of the well wherein an annulus 350 is formed between outer surface 312 and an open hole wall 301*a*. Once in the hole, if the string is not already pressure tight to permit pressure manipulations, this is achieved. Before or after that, the tubing string may be set in the hole. If necessary, the string inner diameter including bore 314 below port 322*a* and possibly annulus 350 below port 322*b* may be sealed as by filling with high density liquid and/or by installation of plugs, diverters or packers to deter cement from passing beyond a selected distance below ports 322*a*, 322*b*. In one embodiment, for example, a packer may be set in the annulus downhole of the stage tool and a high density liquid may be introduced to the tubing string.

Once the tubing string is positioned, ports 322*a*, 322*b* may be opened. The port may be opened, for example, at least when it is desired to initiate a cementing operation through stage tool 310. However, in some cases, ports 322*a*, 322*b* may be opened earlier, for example, where fluid is required for circulation or introduction of fluids to the annulus. To open ports 322*a*, 322*b*, removable closure 330 is removed from its blocking position in the side pocket. Closure 330 is moved by establishing a pressure differential between its ends to push the closure like a piston along chamber 328. The pressure differential is established by pressuring up the tubing string, and therefore bore 314 which is open to a first end of the closure, to a pressure greater than that in the annulus, which is in communication with the opposite end of the closure, through vent 338.

Once fluid pressure is increased to a sufficient level to overcome the holding strength of shear pin 332, closure 330 moves along chamber 328 away from its blocking position between ports 322*a*, 322*b*. In the illustrated tool, closure 330 is driven, arrows A, by pressure, arrows C, to be fully expelled through vent 338 from the side pocket, which leaves vent 338 open and offers greater flow area for cement to pass.

Where the illustrated tool is employed in a string having other fluid pressure actuated components, the driving pressure required to move closure 330 should be selected with consideration as to the other components to be actuated and if they need be actuated before or with the closure. For example, the closure may be selected to only move at pressures greater than the pressures required to move components that must be moved earlier in the tubing string handling, such as, for example, may include packers, slips, etc.

Cement is then introduced, arrows C, to inner bore 314 which flows out through ports 322*a*, 322*b* and vent 338, into the annulus. The ports, being opened to fluid passage therethrough, permit cementing of the annulus through the stage tool. The cement may be pumped from surface to bore 314 and out through the ports. Introduction of cement continues, as desired, until a suitable volume has been introduced.

During this operation, it is noted that closing plug 336 and back up sleeve 360 are held in retracted positions.

When sufficient cement has been introduced, ports 322*a*, 322*b* are closed to hold the cement in the annulus, thereby preventing U-tubing. To close the ports, balls 347 may be introduced to the string, for example, by releasing at the surface, to land in and plug ports 322*a* and block fluid flow therethrough. This ensures that a pressure differential may be established between the ends of closing plug 336, for example, between end 336*a* exposed in opening 342 and the opposite end open to annular pressure. Balls 347 may be pumped downhole with cement, or more likely with the spacer or displacement flush fluids following after the cement. To ensure proper sealing, an excess number of balls may be launched for example, two or three times as many balls may be launched as there are ports.

Once the balls have sealed, the fluid pressure will increase and can be monitored at surface. Then tubing pressure can be increased until the shear pressure of pin 340 is reached. This causes the closing plug to be driven along chamber 328 to a position blocking fluid flow between the inner cementing ports and the outer cementing ports and vent 338. Movement of closing plug 336 will continue until shoulder 348 is stopped against a shoulder 349 of the stage tool. Seals 339 and longitudinal seals, not shown, seal against leaks about the closing plug. Shoulder 348 is positioned, therefore, to ensure that movement of the closing plug is stopped when the seals 339 straddle port 322*a*. A locking structure such as a ratchet or detent, may be employed to ensure that the closing plug is not driven back when tubing pressure is dissipated. If chamber 328 is cylindrical, rather than a faceted shape as shown, and the closing plug seals are positionally restricted, sliding movement may be guided and permitted by a torque key riding in a slot.

This, then, holds the cement in the annulus and time is allowed for the cement to set.

If balls 347 are entrained in the spacer or displacement fluid, they will fall away or be easily moved away from cementing ports 322*a* when the closing plug passes over the ports, at which point no pressure differential is felt through those ports.

If desired, a backup closing sleeve 360 may be carried by the tool to act as a backup seal against fluid leakage after the closing plug is engaged. For example, sleeve 360 may be positioned and sized to close both the port 322*a* and opening 342 to the side pocket, which are the two paths through which leaks may arise back into bore 314. Sleeve 360 may be moved along bore 314 by engagement with a shifting tool and in this embodiment pushed down. An annular recess 366 may be provided to permit sleeve 360 to be recessed out of the main ID of bore 314 and to provide stop walls 372, 373 against which the sleeve may be stored and stopped.

While it is unlikely that balls 347 would still be positioned against ports 322*a* when sleeve 360 is moved, if they were still in place, they are pushed aside by sleeve 360 as it is moved.

In the method, to facilitate reentry and/or fluid communication past tool 310, a chasing plug of liquid may be pumped just before the ports are closed by plug 336. As such, it is likely that any fluid remaining in the string may be devoid of settable cement. The chasing plug may, for example, include retarder, water, etc. However, if there is concern of cement remaining in the bore, there may be a cleanup run with a milling tool. The milling tool will drill up any cement and any balls 347 that are encountered.

After the cement is placed and set, wellbore operations may proceed. In some embodiments, wellbore operations may include wellbore fluid treatments such as stimulation including fracturing. In such an embodiment, string manipulations may be necessary below the stage tool. For example, fluid treatment ports may be opened below the stage tool through which treatment fluids will be communicated, sometimes under pressure to the formation. In one embodiment, for example a fracing operation may be carried out on a formation accessed through the wellbore below the stage tool. During fracturing fluids under pressure may be introduced through the tubing string, passing through inner bore 314 of tool 310, and injecting the fluids under pressure out from the tubing string through ports downhole of the stage tool.

In some instances, string manipulation may include pressuring up the string inner bore including bore 314 of the stage tool. As such, the closing plug seals and back up seals should be considered relative to the pressures required thereafter to manipulate the string components. In some instances, tools, free or connected to strings, must be passed through the string inner bore including bore 314 of the stage tool. Because the stage tool presents a full bore ID, substantially without inner diameter constrictions and without the need of internal plugs, such operations are facilitated.

Referring to FIG. 3, another stage tool 410 for installation in a wellbore liner is shown. The stage tool is both opened for cement circulation therethrough and closed by hydraulic actuation, without conveying full bore cementing plugs and without the use of primary seals or sealing surfaces open in the inner bore.

Stage tool 410 includes a main body including a tubular wall 411 with an outer surface 412 and a longitudinal bore 414 extending from a top end 418 to a bottom end 420. A side pocket extends alongside the tubular wall, the side pocket including a wall 426 with an outwardly facing surface 426*a* and an inner facing surface defining a chamber 428. While the chamber is in fluid communication with the bore, the chamber is separated from bore and no part of the side pocket protrudes into the full bore diameter of bore 414 so that the bore remains fully open.

A cementing port bisects the chamber and includes an inner cementing port 422*a* passing through tubular wall 411 into the chamber and, when opened, providing fluidic access between the longitudinal bore 414 and chamber 428 and an outer cementing port 422*b* passing through outer wall 426 and, when opened, providing fluidic access between the chamber and the outwardly facing surface 426*a*.

A side pocket closure 430 is positioned between inner cementing port 422*a* and outer cementing port 422*b* and is moveable within chamber 428 from a position sealing against fluid communication between the longitudinal bore and the outwardly facing surface to a position retracted from the inner cementing port and the outer cementing port to permit fluid flow through the chamber between the longitudinal bore and the outwardly facing surface. A closing plug 436 is also positioned in the side pocket and is moveable within chamber 428 from a retracted position, which does not affect fluid flow through the chamber between the longitudinal bore and the outwardly facing surface and a final sealing position, where plug 436 is positioned to seal against fluid communication between the longitudinal bore and the outwardly facing surface. While the side pocket closure and the closing plug can be joined, in this illustrated embodiment they are separate structures.

The side pocket closure and the closing plug are positioned entirely outside of the inner bore of the tubular wall, so that bore 414 remains fully open.

Figure 3A:
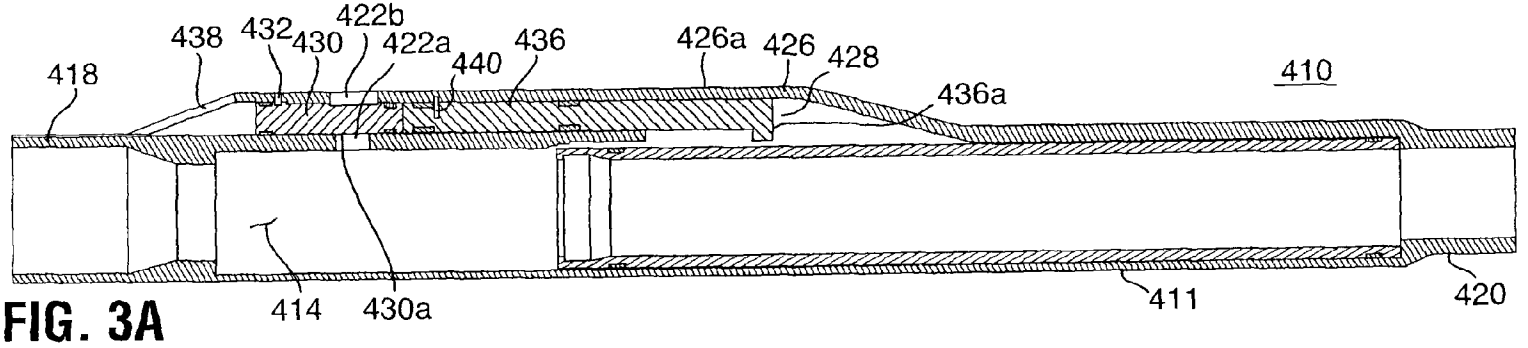
Figure 3B:
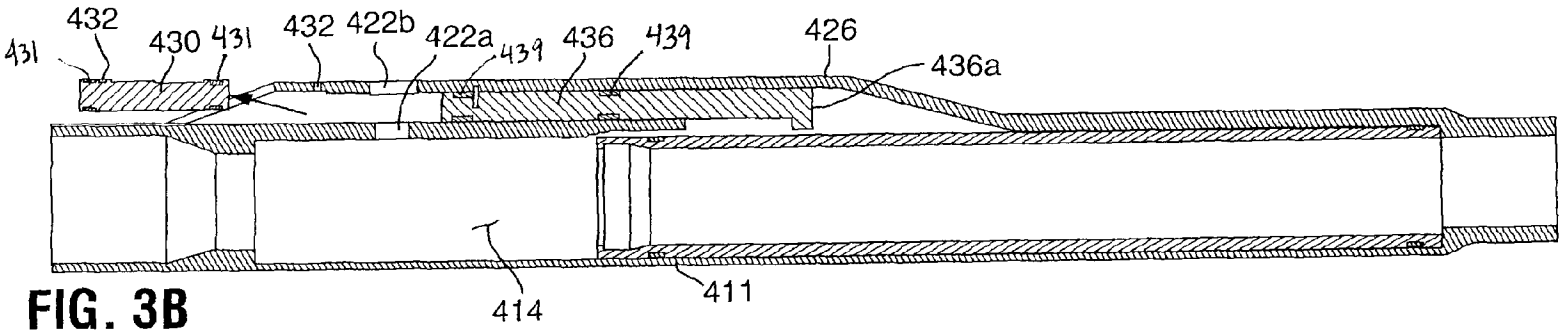
Figure 3C:
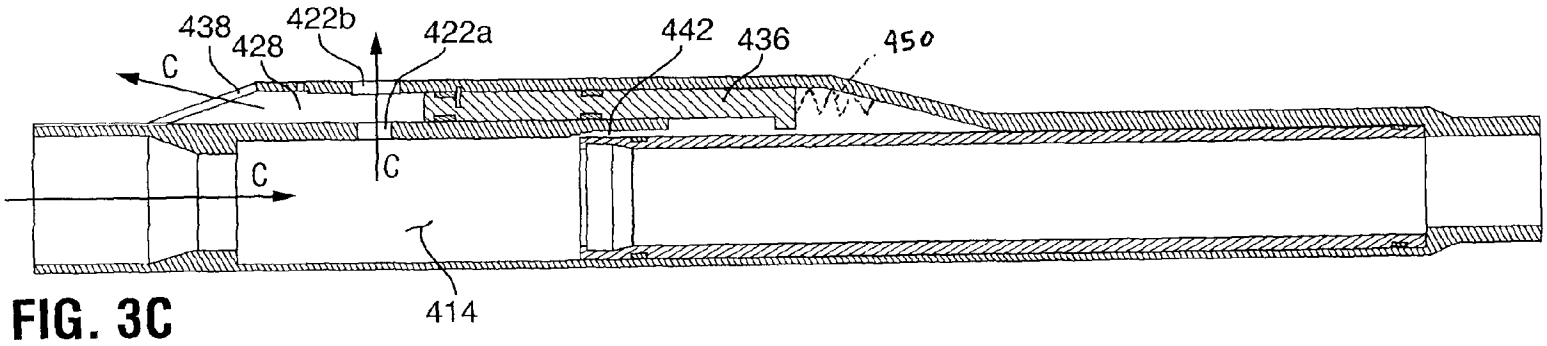
Figure 3D:
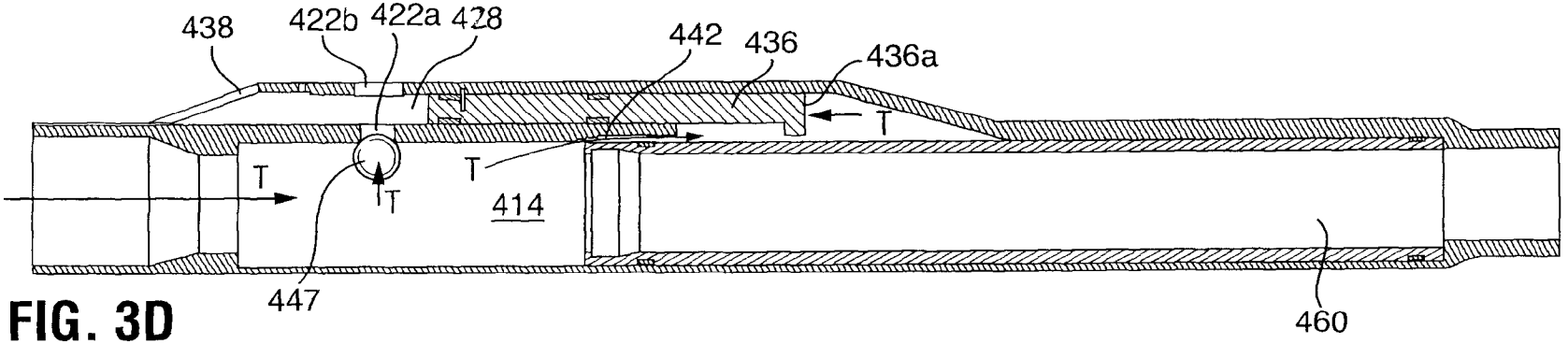
Figure 3E:
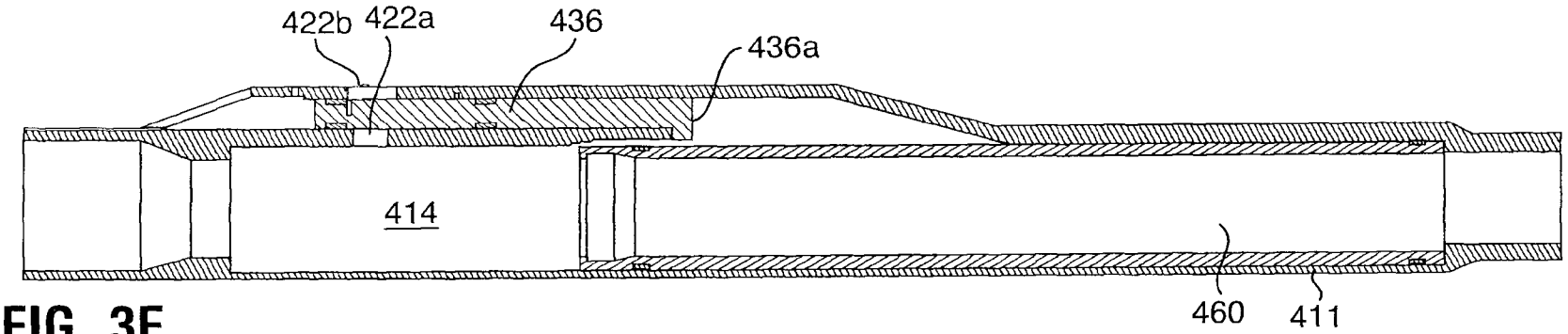

Stage tool 410 is configurable into at least three positions, including (i) as shown in FIG. 3A a run in position, wherein the side pocket closure is positioned between the inner cementing port and the outer cementing port sealing against fluid communication between the longitudinal bore and the outwardly facing surface; (ii) as shown in FIG. 3C, a cementing position, wherein the side pocket closure is displaced from between the inner cementing port and the outer cementing port; and (iii) as shown in FIG. 3E, a cement retaining position, wherein closing plug 436 is positioned between inner cementing port 422*a* and outer cementing port 422*b* sealing against fluid communication between the longitudinal bore and the outwardly facing surface.

Side pocket closure 430 is held in its initial place by a releasable holding mechanism 432, in the form of a shear pin and closure 430 includes a piston face 430*a* in communication with the longitudinal bore. The closure is responsive to a pressure differential set up between the longitudinal bore and outer surface 412.

The outer wall includes a vent 438 through which side pocket closure 430 can be expelled from the stage tool once displaced by fluid pressure.

Closing plug 436 also is held in its initial place by a releasable holding mechanism 440, in the form of a shear pin, and includes a piston face 436*a* in communication with longitudinal bore 414, for example through an opening 442, the piston face is responsive to a pressure differential set up between the longitudinal bore and an annulus about the outer surface. The shear pins 432 and 440 can be the same rating as the pressure to move closure 430 will not also affect closing plug 436, as the pressure creating a pressure differential across closure 430 can be equalized across closing plug 436.

To permit a pressure differential to be established across the closing plug, it may be necessary to seal off inner cementing ports 422*a*. A port plugging structure 447 may be provided, which is sized to seal the inner cementing port to permit the establishment of a pressure differential relative to piston face 436*a*, while fluid is communicated through opening 442.

In the illustrated embodiment, for example, opening 442 extends through tubular wall 411 into chamber 428 at a first end of the chamber. Tubing pressure can be communicated to chamber 428 through opening 442 and vent 438 is positioned at an opposite end of the chamber extending from the chamber through the outer wall through which annular pressure is communicated to the chamber. The outer wall of the side pocket is shaped so that chamber 428 has an elongate tubular form through which the inner cementing port and the outer cementing port bisect at a location between opening 442 and vent 438. The side pocket closure is positioned between the inner cementing port and the vent and the closing plug is positioned with its piston face 436*a* exposed to tubing pressure through opening 442 and its other end exposed to flows through the inner cementing port, the outer cementing port and vent 438. Thus, to create a pressure differential across closing plug 436, fluid communication through ports 422*a* must be closed. Thus, in this illustrated embodiment port plugging structure 447 is conveyed, arrows T, to land against and seal ports 422*a*. In this embodiment, port plugging structure 447 is in the form of a ball sized to seat against the edges of the inner cementing port. Once structure 447 is positioned to seal across port 422*a*, a pressure differential relative to piston face 436*a* can be established, since tubing pressure continues to be communicated through opening 442 to a first end of plug 436 and the opposite end of the plug is open to annular pressure, which is lower than tubing pressure.

In this embodiment, the stage tool further includes a backup sleeve 460 movable to overlie all possible leaks paths into the bore including inner cementing port 422*a* and to seal against fluid flow therethrough.

Figure 3F:
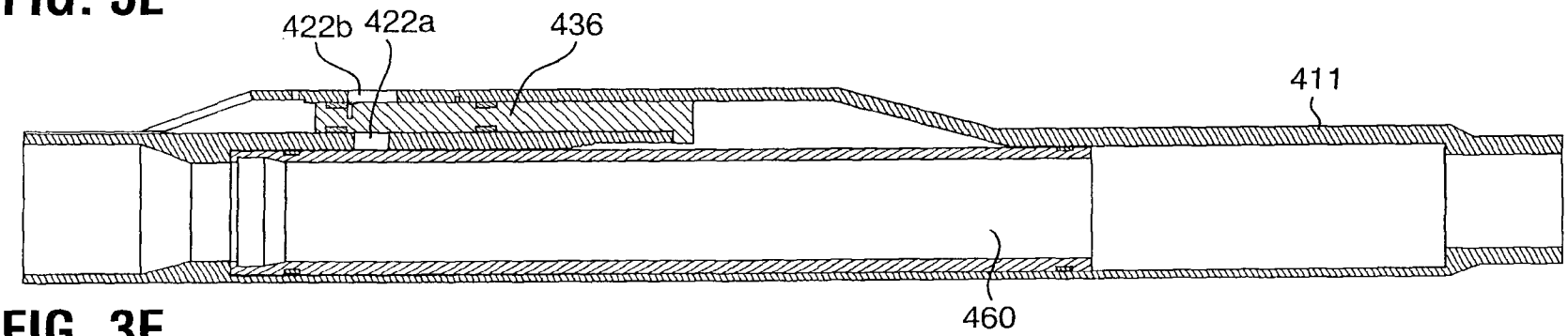

Having thus described the components of the example stage tool 410, the operation of that stage tool will be described. The stage tool may be run into and set in the hole in a condition as shown in FIG. 3A and may be manipulated by hydraulics as shown in FIG. 3B to open ports 422*a*, 422*b* by expelling closure 430. This configures the sub to a condition shown in FIG. 3C for stage cementing. After the introduction of cement, arrows C, is complete, the tool may be manipulated hydraulically, arrows T, as shown in FIG. 3D to a condition shown in FIG. 3E to move plug 436 to close off communication through the cementing ports 422*a*, 422*b* between the annulus and the inner bore of the tool. As a contingency, if the stage tool leaks, backup closing sleeve 460 can be moved across the leak paths at 422*a*, 442, as shown in FIG. 3F.

Compared to the stage tool of FIG. 2, stage tool 410 of FIG. 3 opens a cementing port 438 pointing towards the upper end 418, which is the end towards surface. This facilitates cementing, as the cement when exiting the stage tool is already moving towards surface, rather than having to turn direction after exiting the tool. Also, stage tool 410 has fewer inner ports 422*a* than the tool of FIG. 2. This reduces the number of plugging structures that must be used to seal the ports 422*a*. Also, while the open area provided by port 422*a* could be sized variously, in this embodiment, it is maintained relatively small, which allows the open sectional area through chamber 428 to be maintained relatively small.

Other modifications can be made if desired to the tools described herein. For example, in one embodiment, a biasing member, such as for example a spring 450 (shown in FIG. 3C in phantom for illustrative purposes only), is positioned to bias plug 436 into a port closed position. The biasing member normally applies a force against end 436*a*. The biasing member may not on its own apply a force to overcome pins 440 to move plug 436 through the side pocket. However, the biasing member ensures that the plug is urged to move readily as soon as a pressure differential is sensed across the plug sufficient to overcome pins 440. Alternately or in addition, some stage tools omit one of vent 438 or outer port 422*b*, as both are not needed. In one embodiment, for example, port 422*b* is omitted and only vent 438 is employed which is axially offset from inner port 422*a*, as this retains the ability to eject plug 430 and pump of cement out of the stage tool, while facilitating the placement of seals 431 on plug 430 and seals 439 on plug 436.

EXAMPLES

In one embodiment, an example technical operations procedure is suggested. This is provided to assist with understanding, but not to be considered restrictive of the invention. The suggested example is as follows:

Pre-Job Planning

During the planning stages, the hydrostatic forces should be calculated to determine the shear value for the fluid treatment ports. The difference between the cement density and the density of the displacement fluid should be considered at the proposed depths of the stage tool.

Wellbore hydraulics should be considered to ensure that the differential pressure will not cause a "light pipe" condition due to string buoyancy.

Shear pin timing should be considered in the program design. The stage tool closure should be set to shear higher than the any string packers to be set by hydraulics, and lower than the any opening mechanism for wellbore fluid treatment ports, with a reasonable safety factor.

Placement

The stage tool should be run in the tool string to a depth to give a minimum of 1 (6.5 bbl) and possibly 2 $m^3$ (13 bbl) of annular volume to the planned bottom of the cemented zone, when possible, to allow for adequate flushing.

The tool should be run directly above an annular packer such as an open hole packer possibly also including slips for both zonal isolation in the annulus below the cementing ports and for positional locking in the wellbore.

The stage tool may be positioned to permit cementing at the heel of the well.

Run in Hole

Run in hole (RIH) speeds may be limited by the packers.

The stage tool closure is locked in place only to be released hydraulically.

Once the liner is at depth, the packers can be set, for example if hydraulically set by pressuring up the string, and pressure tested following the procedure for these tools.

Once the packers have been set and tested, the string may be pulled into tension (for example to about 2,000-5,000 daN) in preparation for cementing.

Tool Function: Cementing

The pressure should be brought up to opening pressure to displace the closure blocking the stage tool ports. Increasing pressure in stages will increase the setting force on the hydraulic packers.

Once the ports are open, circulation back to surface should be established with the existing well fluid.

Once circulation is achieved, the cement program can begin with any required pre-flush, and move into the cement at the planned volumes.

After pumping the required volume of cement, the pumping should be switched over to a 0.5 to 1.5 $m^3$ high viscosity wiper pill and then on to the displacement fluid, preferably without pausing between stages. No wiper plugs are dropped during these steps.

Tool Function: Closing the Ports

During the circulation of displacement volumes, cementing port plugging balls are dropped and circulate with the fluid until they land against the inner cementing ports. The balls are selected to have a diameter at least slightly larger than the diameter of the inner cementing ports and with a generally similar shape (i.e. a circular port and a substantially spherical ball). Approximately two to three times as many balls are dropped as the number of inner cementing ports to be plugged.

To close the cementing ports against U-tubing, the pressure should be brought up to the pressure to drive the closing plug (normally less than 1000 psi), while the plugs seal the inner cementing ports. This moves the closing plug through the side pocket into a sealing position between the stage tool inner cementing port and the outer cementing port/vent.

Thereafter the valves at the pumping unit should be slowly opened to monitor for any fluid returns; if no fluid returns are present, this confirms that the stage tool ports are closed.

If the stage tool ports are closed, rig out cementing equipment.

After the cement is set, before fracturing occurs, the backup sleeve can be shifted closed with a shifting tool as a safety and/or milling can be conducted to clean out the ID.

Remedial Step—Port Seals not Holding

If port seals do not hold, all returned volume should be pumped back to the well.

If fluid still returns to the pumping unit during the flow back test, a shifting tool is run into the well to shift the backup sleeve.

Monitor for any fluid returns; if no fluid returns are present, this confirms that the stage tool ports are closed. If the stage tool ports are closed, rig out cementing equipment and WOC.

The previous description of the disclosed embodiments is provided to enable any person skilled in the art to make or use the present invention. Various modifications to those embodiments will be readily apparent to those skilled in the art, and the generic principles defined herein may be applied to other embodiments. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Nothing disclosed herein is intended to be dedicated to the public regardless of whether such disclosure is explicitly recited in the claims.

The invention claimed is:

1. A stage tool for wellbore annular cementing, comprising:

a main body including a tubular wall with an outer surface and a longitudinal bore extending from a top end to a bottom end;

a side pocket extending adjacent to the tubular wall, the side pocket including an outer wall defining a chamber between the outer wall and the longitudinal bore, the outer wall having an outwardly facing surface;

an inner cementing port passing through the tubular wall and, when opened, providing fluidic access between the longitudinal bore and the chamber;

an outer cementing port passing through the outer wall and, when opened, providing fluidic access between the chamber and the outwardly facing surface;

a side pocket closure positioned between the inner cementing port and the outer cementing port and moveable within the chamber from a position sealing against fluid communication between the longitudinal bore and the outwardly facing surface to a position retracted from the inner cementing port and the outer cementing port to permit fluid flow through the chamber between the longitudinal bore and the outwardly facing surface; and a closing plug in the side pocket and moveable within the chamber from a retracted position to permit fluid flow through the chamber between the longitudinal bore and the outwardly facing surface and a position sealing against fluid communication between the longitudinal bore and the outwardly facing surface; and an opening through the tubular wall into the chamber at a first end of the chamber through which tubing pressure is communicated to the chamber and a vent at an opposite end of the chamber through the outer wall through which annular pressure is communicated to the chamber.

2. The stage tool of claim 1 wherein the side pocket closure includes a piston face in communication with the longitudinal bore, the piston face responsive to a pressure differential set up between the longitudinal bore and an annulus about the outer surface.

3. The stage tool of claim 1 wherein the stage tool is configurable in at least three positions: a run in position, wherein the side pocket closure is positioned between the inner cementing port and the outer cementing port sealing against fluid communication between the longitudinal bore and the outwardly facing surface; a cementing position, wherein the side pocket closure is displaced from between the inner cementing port and the outer cementing port; and a cement retaining position, wherein the closing plug is positioned between the inner cementing port and the outer cementing port sealing against fluid communication between the longitudinal bore and the outwardly facing surface.

4. The stage tool of claim 1, wherein the side pocket releases the side pocket closure from the side pocket in the retracted position.

5. The stage tool of claim 1, wherein the side pocket closure and the closing plug are positioned entirely outside of the inner bore of the tubular wall.

6. The stage tool of claim 1, wherein the side pocket closure and the closing plug are separate structures.

7. The stage tool of claim 6, wherein the closing plug includes a piston face in communication with the longitudinal bore, the piston face responsive to a pressure differential set up between the longitudinal bore and an annulus about the outer surface.

8. The stage tool of claim 7, further comprising a port sealing plug sized to seal the inner cementing port to permit the establishment of a pressure differential relative to the piston face.

9. The stage tool of claim 1, wherein the outer wall defines the chamber with an elongate tubular form through which the inner cementing port and the outer cementing port bisect between the opening and the vent, and wherein the side pocket closure is positioned between the inner cementing port and the vent and the closing plug is positioned between the inner cementing port and the opening.

10. The stage tool of claim 1, further comprising a backup sleeve movable to overlie the inner cementing port and to seal against fluid flow therethrough.

11. A method for stage cementing a wellbore annulus, the method comprising:

running a tubing string comprising a side pocket into a wellbore toward bottom hole in the wellbore;

setting the tubing string in the wellbore to create the wellbore annulus between the tubing string and a wall of the wellbore;

opening a cementing port through the side pocket;

pumping cement through the cementing port; and closing the cementing port to hold the cement in the annulus by:

releasing a port sealing plug in the tubing string to seal the cementing port, pressuring up the tubing string to establish a pressure differential across a closing plug in the side pocket; and driving the closing plug through the side pocket to seal the cementing port.

12. The method of claim 11, further comprising setting a packer in the wellbore annulus between the stage tool cementing port and the bottom hole.

13. The method of claim 11, wherein the tubing string includes a tool-actuated mechanism below the stage tool and the method further comprises, after closing a cementing port, launching a tool to pass through the stage tool and actuate the tool-actuated mechanism.

14. The method of claim 11 further comprising after closing the cementing port, fracturing a formation accessed by the wellbore below the stage tool.

15. The method of claim 11 wherein positioning includes placing the cementing port adjacent an open hole region of the wellbore and placing sufficient cement to extend upwardly to a casing point in the wellbore.

16. The method of claim 11 wherein pumping cement and closing the cementing ports proceed without launching a full bore cementing plug.

17. The method of claim 11, further comprising after closing the cementing port, moving a back-up sleeve to overlie and close the cementing port.

18. The method of claim 11, wherein opening the cementing port includes driving a closure hydraulically away from the cementing port.

19. The method of claim 18, wherein driving the closure includes expelling the closure from the side pocket into the annulus.

* * * * *